United States Patent [19]

Corey et al.

[11] 4,130,215

[45] Dec. 19, 1978

[54] NO SPILL BEVERAGE CUP

[76] Inventors: Joe F. Corey, 11846 Ridgeout, Whittier, Calif. 90601; Tony G. Corey, 11432 Aldrich, Whittier, Calif. 90606

[21] Appl. No.: 876,729

[22] Filed: Feb. 10, 1978

[51] Int. Cl.[2] ..... A47G 19/22

[52] U.S. Cl. ..... 220/90.4

[58] Field of Search ..... 215/100 R; 220/90.2, 220/90.4, 90.6; 210/469

[56] References Cited

U.S. PATENT DOCUMENTS

| | | | |
|---|---|---|---|
| 2,858,041 | 10/1958 | Robinson | 220/90.4 |
| 3,360,161 | 12/1967 | Smith | 220/90.4 |

FOREIGN PATENT DOCUMENTS

| | | | |
|---|---|---|---|
| 24619 | 11/1906 | United Kingdom | 220/90.4 |

*Primary Examiner*—Donald F. Norton

*Attorney, Agent, or Firm*—Edgar W. Averill, Jr.

[57] ABSTRACT

A drinking cup having a substantially reduced tendency to spill. The cup has at least two baffle members positioned within the cup wall. Each baffle is generally annular having a central opening and each baffle contains a plurality of passageways passing therethrough.

10 Claims, 4 Drawing Figures

NO SPILL BEVERAGE CUP

BACKGROUND OF THE INVENTION

The field of the invention is drinking cups and the invention relates more particularly to cups adapted with means to reduce the tendency to splash or spill. Such cups are especially useful for coffee, tea and other hot or cold beverages where splashing can be painful as well as inconvenient.

Many devices are used to reduce the tendency of drinking cups to spill. The most common device is a thin plastic cap which is commonly placed over the upper lid of a paper or plastic cup. For beverages drunk by use of a straw, a straw opening is commonly provided in the lid and provides adequate protection against spills. The straw opening is, of course, not useful for coffee, tea or other hot liquids not typically drunk with a straw. For such liquids it is necessary to remove the lid at which point there is no protection against spilling or slopping. Other no spill approaches are disclosed in U.S. Pat. Nos. 3,360,161, 3,952,910, 3,360,160, 3,549,044, 3,171,580, 3,730,399, 3,868,043, 3,938,695, 2,753,049, 3,994,411 and 3,940,012. All of the devices described in the above listed patents suffer from various deficiencies. A common deficiency is the inability of the user to add cream, sugar, ice, lemon or the like without removing the lid or spill preventer. Similarly, for most of the devices the user cannot use a spoon or other stirring device without removing the lid or baffle.

SUMMARY OF THE INVENTION

It is the primary object of the present invention to provide a drinking cup which has a substantially reduced tendency to splash or spill while at the same time enabling the user to stir the contents of the cup while still performing a baffling function.

The present invention is for a drinking cup having a substantially reduced tendency to spill. The cup has at least two baffle members positioned along the inner surface of the side wall near the upper lip but positioned downwardly therefrom. Each baffle is generally annular in shape and extends outwardly from the cup wall. Each baffle has a central opening at least one-third of the maximum diameter of the inside wall of the cup, and each baffle also has a plurality of passageways passing therethrough from the lower surface to the upper surface thereof.

The passageways may be circular holes or elongated slots and preferably are offset so that the passageways in the upper baffle do not coincide with the passageways in the adjacent lower baffle. One or two enlarged slots may be provided to facilitate drinking.

DESCRIPTION OF THE PREFERRED EMBODIMENTS

Figure 1:
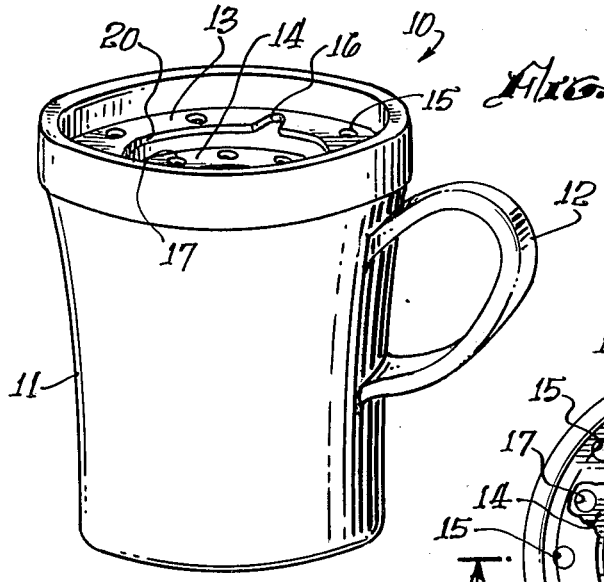
FIG. 1 is a perspective view of the present invention.

A cup according to the present invention is indicated by reference character 10 in FIG. 1. The cup has a generally cylindrical side wall 11 and handle 12 of a conventional design. The cup also has an upper baffle 13 and lower baffle 14 described more fully below.

Figure 2:
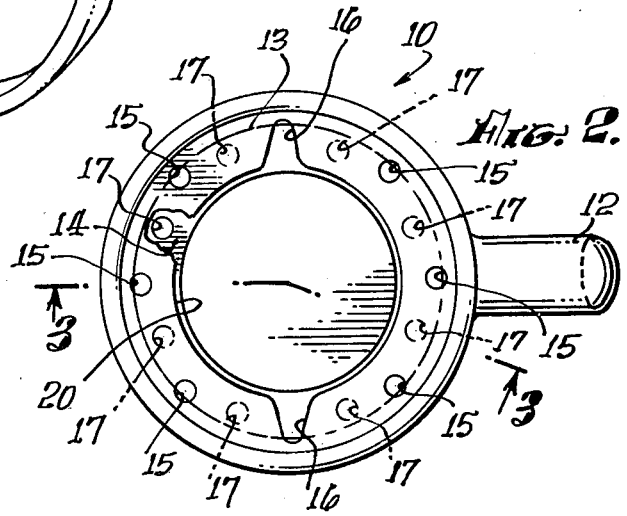
FIG. 2 is a plan view, partially cut away, of the cup of FIG. 1.

As shown in FIG. 2 the upper baffle 13 has six passageways comprising holes 15 and two slots 16. The holes pass completely through the upper baffle as do slots 16. Lower baffle 14 also has a plurality of holes indicated by reference character 17. Eight holes are shown in each baffle but a greater or smaller number may be used. As few as four or as many as twenty-four is contemplated. The number and size of the holes should not be so great as to destroy the baffling effect and thus it is preferred that no more than 50 percent of the area of the baffle consists of holes. The openings are preferably positioned near the mid-point of the annular baffle or if the openings are slots the slots may pass completely through the baffle. Holes 17 are offset from holes 15 and slots 16 so that liquid passing through holes 17 are not likely to be able to likewise pass through holes 15 or slots 16.

The two baffles are shown most clearly in cross-sectional view in FIG. 3 where it can be readily seen that the baffles are disposed in the upper half of the cup and substantially below the upper lip thereof so that they do not interfere with drinking from the cup. Slots 16 although useful are not essential for the practice of the present invention. These slots increase the flow of liquid facilitating the more rapid drinking of the contents. A substantial disadvantage of most non-spill cups of the prior art is the difficulty associated with drinking the contents. This is particularly true when fast drinking is desired since many no-spill cups rely on small openings which simply do not permit rapid drinking. Upper baffle 13 has a central opening 20 which should be at least $\frac{1}{3}$ of the diameter of the cup and preferably at least $\frac{1}{2}$ thereof. Similarly, lower baffle 14 has an opening 21 which similarly should be at least $\frac{1}{3}$ and preferably $\frac{1}{2}$ the diameter of the cup. In this way, sugar, cream, as well as a spoon may be used in the cup while the baffles are in place.

Figure 3:
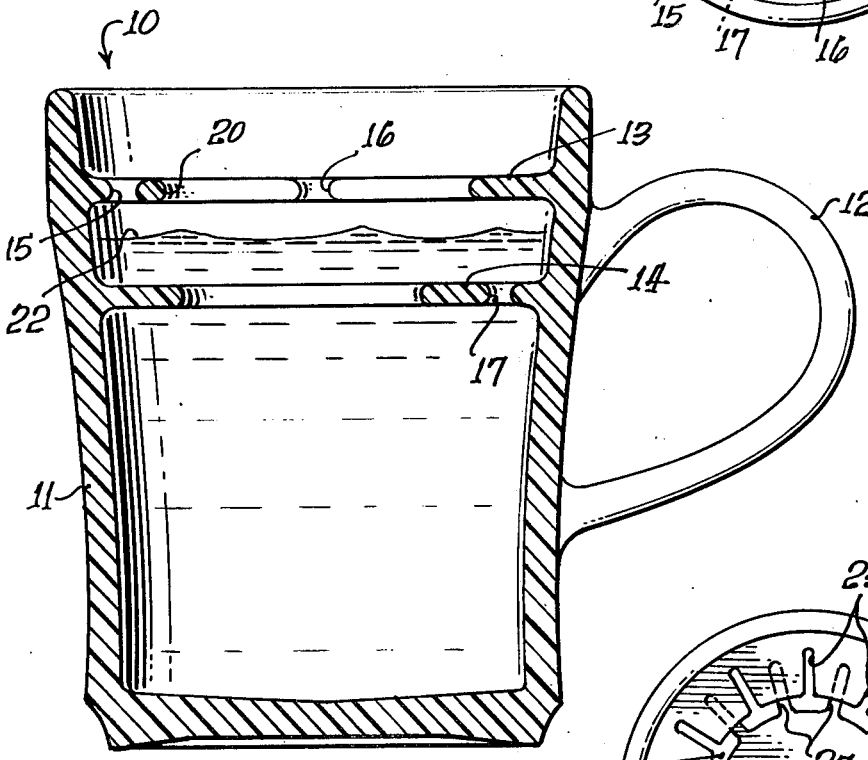
FIG. 3 is a cross-sectional view taken along line 3—3 of FIG. 2.

When the cup is full, the liquid level is slightly below the upper baffle as shown in FIG. 3 where the liquid level is indicated by reference character 22. Even with the liquid level up to the level of the upper baffle 13, the tendency to spill is nonetheless substantially reduced by the presence of the two baffles. More than two baffles may be used in the practice of the present invention and additional lower baffles serve to facilitate the non-spill effect of the present invention. Three or four baffles are very useful with the addition of more baffles being of less effect in that the tendency to spill is not substantially reduced with the use of five baffles as compared to four.

Figure 4:
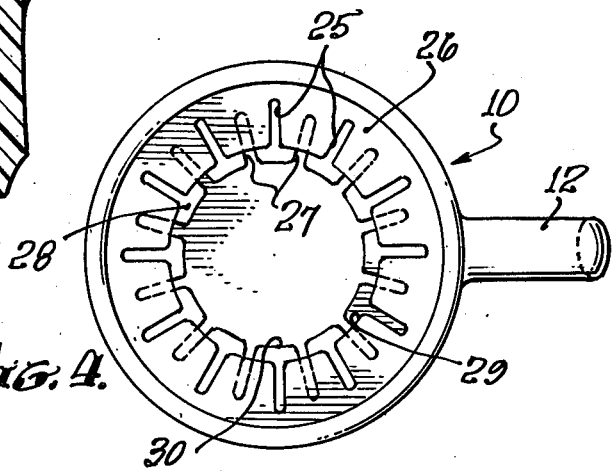
FIG. 4 is a plan view of an alternate embodiment of the cup of the present invention.

An alternate configuration of the present invention is shown in FIG. 4 where the passageways are elongated slots. Slots 25 are positioned in upper baffle 26 and slots 27 are positioned in lower baffle 28. As above, slots 27 are offset from slots 25 to reduce the spilling tendency. Upper baffle 26 has a central opening 29. Lower baffle 28 has a central opening 30, again for the purpose of facilitating stirring and the adding of sugar, cream and the like. The central openings have the further advantage of facilitating the rapid drinking or gulping of the contents as well as for emptying and washing the cup. It is important in the practice of the present invention that the baffles be touching the inner wall of the cup and have a central opening for stirring. Ideally the baffles should be generally annular in shape. While the passageways in the two baffles are shown as offset, it is possible to align the two sets of passageways and the present invention may be practiced with aligned passageways.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A drinking cup having a substantially reduced tendency to spill or splash, said cup comprising:

a hollow cup having a base, side wall and upper lip; and at least two baffle members positioned along the inner surface of the side wall of the cup near the upper lip thereof but positioned downwardly therefrom, each of said baffles being generally annular in shape extending outwardly from the cup wall and having a central opening at least ⅓ the maximum diameter of the inside wall of the cup and each of said baffles having a plurality of passageways passing therethrough.

2. The cup of claim 1 wherein the passageways in each baffle are circular holes and positioned midway between the central opening of the baffle and the cup wall.

3. The cup of claim 2 wherein said cup has two baffles.

4. The cup of claim 2 wherein each baffle has eight holes passing therethrough.

5. The cup of claim 1 wherein said passageways are elongated slots extending from the central opening to a point about touching the side wall of the cup.

6. The cup of claim 1 wherein the passageways in the top baffle are not aligned vertically with the passageways in the adjacent lower baffle.

7. The cup of claim 1 further including an enlarged slot in the upper baffle.

8. The cup of claim 7 further including a handle positioned about 90° from the position of said enlarged slot.

9. The cup of claim 8 containing a second enlarged slot positioned 180° from the first enlarged slot.

10. The cup of claim 1 wherein said baffles are integrally formed into the cup wall.

* * * * *